United States Patent [19]

Aoki et al.

[11] Patent Number: 4,674,592

[45] Date of Patent: Jun. 23, 1987

[54] DIAPHRAGM FOR USE IN ELECTRO-ACOUSTIC TRANSDUCER

[75] Inventors: Shuichi Aoki, Tokyo; Katsuyoshi Kumagai, Yamagata; Akihiko Haga, Yamagata; Minoru Ito, Yamagata, all of Japan

[73] Assignee: Alpine Electronics Inc., Tokyo, Japan

[21] Appl. No.: 796,896

[22] Filed: Nov. 12, 1985

[30] Foreign Application Priority Data

Nov. 14, 1984 [JP] Japan ..... 59-238566

[51] Int. Cl.[4] ..... G10K 13/00

[52] U.S. Cl. ..... 181/170; 428/64; 428/341; 428/342; 428/476.3; 428/479.3; 428/479.6

[58] Field of Search ..... 181/157, 167, 169, 170; 428/64, 341, 342, 476.3, 479.3, 479.6

[56] References Cited

U.S. PATENT DOCUMENTS 2,006,830 7/1935 Howley ..... 181/169
4,076,098 2/1978 Wood ..... 181/170

FOREIGN PATENT DOCUMENTS 0071619 6/1979 Japan ..... 181/170

*Primary Examiner*—Benjamin R. Fuller
*Attorney, Agent, or Firm*—Murray and Whisenhunt

[57] ABSTRACT

A diaphragm for use in an electro-acoustic transducer comprises a diaphragm main body only or mainly composed of natural fibers, a layer formed by laminating thereover a polyamide resin and a synthetic resin coating layer further formed to the surface of the laminate layer. The diaphragm is free from pin holes, exhibits satisfactory water proofness and excellent physical properties such as sonic propagation velocity inherent to the natural fibers. It can be fabricated with ease at a good yield and can reduce the fabrication cost.

1 Claim, 5 Drawing Figures

DIAPHRAGM FOR USE IN ELECTRO-ACOUSTIC TRANSDUCER

BACKGROUND OF THE INVENTION

This invention relates to a diaphragm for use in electro-acoustic transducer such as a loud speaker, microphone or the like.

Diaphragms for use in electro-acoustic transducers such as a speaker or a microphone generally must satisfy the following requirements:

(1) light in weight, (2) high rigidity (Young's modulus E) and moderate inner loss (tan δ)

(3) a high ratio between the Young's modulus E and the density $\rho$, that is, specific modulus $E/\rho$ or great sound propagation velocity $\sqrt{E/\rho}$.

The conventional materials for forming these diaphragms include:

(a) those mainly composed of natural fibers such as plant fibers, animal fibers and mineral fiber, (b) the natural fibers as described above impregnated with thermosetting resin such as phenol resin or epoxy resin, (c) plastic sheet made of polypropylene, polyethylene terephthalate, etc.

(d) metal member such as made of aluminum or titanium.

Among them, the diaphragms made of the natural fibers (a) as the main component can provide a flat frequency characteristic owing to their large inner loss tan δ but they are highly hygroscopic and cause fluctuations in the acoustic tone leading to degradation in the tone by way of aging.

Further, those natural fibers impregnated with a thermosetting resin such as phenol or epoxy resin as described in paragraph (b) above have a low inner loss tan δ and high density $\rho$. Accordingly, the plate thickness has to be reduced in order to decrease the weight of the diaphragm, which results in a defect of peak dip in the frequency characteristic. Further, although the diaphragm made of plastic sheets such as of polypropylene or polyethylene terephthalate as decribed in (c) above is excellent in water proofness, they are liable to cause deformation at a high temperature atmosphere of about 100° C. and require an increased cost.

Furthermore, although the diaphragm shaped by using metal members of aluminum or titanium as described in (d) above has a great Young's modulus E since the inner loss tan δ is small, it is difficult to damp the resonance at a higher frequency region, the ductility of the material is limited to worsen the workability and the cost is extremely expensive.

As described above, the materials (a)–(d) as described above, are not suitable as the material for forming the diaphragms for use in electro-acoustic transducers.

SUMMARY OF THE INVENTION

This invention has been achieved in view of the foregoing problems and the object thereof is to provide a diaphragm for use in electro-acoustic transducers taking advantage of the natural fibers while compensating the drawbacks thereof, having a complete water proofness free from pin holes, with satisfactory workability, reduced in the cost, and capable of attaining flat frequency characteristic at high region, having large physical properties such as Young's modulus E, specific modulus elasticity $E/\rho$ and sound propagation velocity $\sqrt{E/\rho}$. The features of this invention basically resides in a diaphragm for use in an electro-acoustic transducer comprising a laminate layer prepared by laminating a polyamide resin onto a diaphragm main body composed solely or mainly of natural fibers and a synthetic resin coating layer formed on the surface of the laminate layer.

BRIEF DESCRIPTION OF THE DRAWINGS

These and other objects, features and the advantages of this invention will become clearer by the following descriptions made in conjunction with the appended drawings, wherein.

DESCRIPTION OF THE EMBODIMENTS

This invention will now be described referring to several embodiments together with the manufacturing step in conjunction with the drawings.

Figure 1:
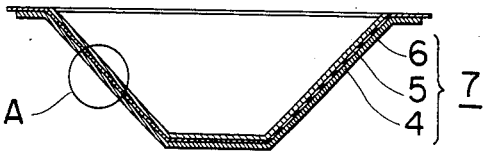
FIG. 1 is a cross sectional view for one embodiment of a diaphragm for use in an electro-acoustic transducer according to this invention.
Figure 2:
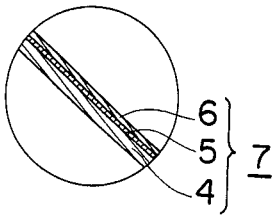
FIG. 2 is an enlarged cross sectional view for a portion within the circle A in FIG. 1.
Figure 3:
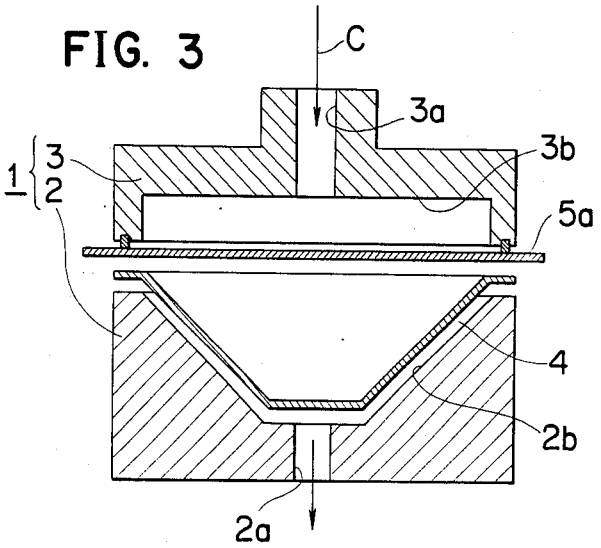
FIG. 3 is a cross sectional view illustrating the step of manufacturing the embodiment shown above.
Figure 4:
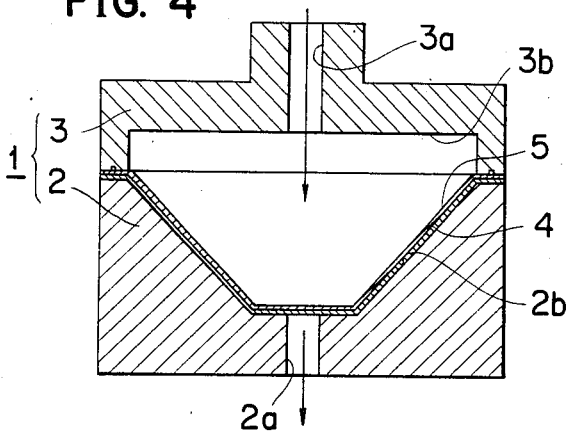
FIG. 4 is a cross sectional view for the state where a plastic film is laminated on the diaphragm main body.

FIG. 3 shows a device 1 as one embodiment used for practicing this invention. The device 1 comprises a lower die 2 and a upper die 3 mating to the lower die 2. The lower die 2 is formed at the inside thereof with a containing recess **1*b* in alignment with the shape of a desired diaphragm main body 4 and in communication with a suction port 2*a*, while the upper die 3 is formed at the inside thereof with an air supply recess 3*b* in communication with an air supply port 3*a* supplied with the pressurized gas such as a pressurized air. The diaphragm main body 4** is made, for example, of cone paper prepared from natural fibers by a paper making process or by spinning natural fibers in admixture with synthetic or semi-synthetic resin.

The diaphragm 4 is formed thereover with a laminate layer 5 which is made of water proofing and heat resistant platic film such as of a thermoplastic polyamide resin. A synthetic resin coating layer 6 is formed on the surface of the laminate layer 5. The synthetic resin coating layer 6 is made, for example, of lacquer enamel paint of nitro-cellulose type having a high surface hardness.

For or manufacturing the diaphragm 7, the diaphragm main body 4 is contained in the containing rescess **2*b* of the lower die 2 at the first step and a polyamide resin film 5*a* as a water proofing and heat resistant thermoplastic material for forming the laminate layer 5 is disposed therabove between the lower die 2 and the upper die 3**.

Then, the film **5*a*** is heated to soften at a selected softening point as the second step.

Further, the upper die 3 is fitted to the lower die 2 while putting the film **5*a* between the upper die 3 and the lower die 2 in the third step. In this case, while the upper die 3 is usually lowered to the lower die 2**, the lower die 2 may be driven upwardly relative to the upper die 3.

Then, by sucking the air to evacuate in the containing recess 2*b* of the lower die 2 at the boundary of the film 5*a* through the suction port 2*a* by using the vacuum pump or the like at the third step 4 and supplying the pressurized air to the inside of the upper die 3 through the pressurizing port 3*a* at the boundary of the film 5*a* by using a compressor or the like. The film 5*a* softened by heating is deformed to form a laminate film 5 on the upper surface of the diaphragm main body 4.

Then, the synthetic resin coating layer 6 is formed on the surface of the laminate layer 5 as the fifth step to manufacture the diaphragm 7.

EXAMPLE 1

At first, a diaphragm main body 4 formed into a cone shape of about 30–400 μm thickness by using pulp fibers of UKP20'SR as the natural fiber in the inside of the containing recess 2*b* of the lower die, while a polyamide resin film 5*a* of 20–50 μm thickness is disposed thereinabove between the upper die 3 and the lower die 2 and heated to soften at a temperature of about 150° C. for several seconds by a heater. Then, the inside of the containing recess 2*b* is evacuated by sucking through the suction port 2*a* of the lower die 2 with a suction pressure, for example, at about 20 cmHg, while pressurized air c is supplied to the inside of the pressurized supply port 3*a* of the upper die 3 under pressure by using a compressor to laminate a polyamide resin film 5*a* of about 20 μm thickness to the upper surface of the diaphragm main body 4 thereby forming the laminate layer 5. Then, a synthetic layer coating layer 6 of about 100 μm thickness made of nitrocellulose type lacquer enamel is formed by spray coating to the surface of the laminate layer 5 thus formed on the diaphragm main body 4 to manufacture a diaphragm 7.

In this example, the thickness of the polyamide resin 5*a* was choosen within a range from 20 to 50 μm. If the film 5*a* of less than 20 μm thickness is laminated to the diaphragm main body 4, it is not suitable in the case of the deep shape since the film 5*a* itself elongates. On the contrary, if a film 5*a* of a thickness greater than 50 μm is laminated on the diaphragm main body 4, the weight of the diaphragm 7 is increased to worsen the sensitivity making it insuitable to use.

EXAMPLE 2

At first, a diaphragm main body 4 formed into a cone shape of about 30–400 μm thickness by using pulp fibers of UKP20'SR as the natural fiber in the inside of the containing recess 2*b* of the lower die, while a polyamide resin film 5*a* of 20–50 μm thickness is disposed thereabove between the upper die 3 and the lower die 2 and heated to soften at a temperature of about 150° C. for several seconds by a heater. Then, the inside of the containing recess 2*b* is evacuated by sucking through the suction port 2*a* of the lower die 2 with a suction pressure, for example, at about 20 cmHg, while pressurized air c is supplied to the inside of the pressurized supply port 3*a* of the upper die 3 under pressure by using a compressor to laminate a polyamide resin film 5*a* of about 20 μm thickness to the upper surface of the diaphragm main body 4 thereby form the laminate layer 5. Then, a synthetic layer coating layer 6 of about 100 μm thickness made of a vinyl acetate resin is formed by spray coating to the surface of the laminate layer 5 to be formed on the diaphragm main body 4 to manufacture a diaphragm 7.

Then physical properties such as the density $\rho$, Young's modulus E, inner loss tan $\delta$, sonic propagation velocity $\sqrt{E/\rho}$ and the like are compared for the diaphragm 7 for use in loud speaker in Examples 1 and 2 obtained in this way, a diaphragm shaped only from pulp fibers of UKP20'SR as the natural fiber not applied with lamination, conventional diaphragm shaped by laminating a polyamide resin of a 40 μm thickness to the pulp fibers of UKP20'SR as the natural fiber not applied with lamination, conventional diaphragm shaped by laminating a polyamide resin of a 40 μm thickness to the pulp fibers of UKP20'SR as the natural fiber and a conventional diaphragm for use in loud speaker shaped by using 100% by weight of polypropylene and 100% by weight of polyethylene terephthalate as the plastics. The results are shown in Table 1 below.

TABLE 1

| | Physical property | | | |
|---|---|---|---|---|
| Diaphragm | Density (g/cm$^3$) | Young's modulus E × $10^{10}$ (dyn/cm$^2$) | Inner loss tan $\delta$ × $10^{-2}$ | propagation velosity E/P × $10^5$ (cm/sec) |
| UKP20'SR pulp fibers | 0.60 | 2.0 | 5.0 | 1.8 |
| UKP20'SR pulp fibers formed with a laminated film of polyamide resin of 40 μm thickness | 0.63 | 2.1 | 5.5 | 1.8 |
| Polypropylene, 100% by weight | 0.90 | 1.8 | 9.0 | 1.4 |
| Polyethylene terephthalate, 100% by weight | 1.40 | 4.5 | 2.0 | 1.8 |
| Example 1 | 0.70 | 2.8 | 5.2 | 2.0 |
| Example 2 | 0.72 | 1.5 | 6.0 | 1.4 |

As apparent from the table 1 above, the density of the diaphragm in Examples 1 and 2 is slightly larger than the density of 0.60 (g/cm$^3$) and 0.63 (g/cm$^3$) in the diaphragms made of the UKP20'SR pulp fibers as the natural fiber and the diaphragm comprising the diaphragm main body made of UKP20'SR pulb fiber formed only with the polyamide resin laminate layer of 40 μm thickness, but significantly lower than the density of 0.90 (g/cm$^3$) and 1.40 (g/cm$^3$) of the conventional diaphragm made of polypropylene or polyethlene terephthalate and, accordingly, greatly reduced in weight. Referring to the Young's modulus E, the diaphragm of Example 1 according to this invention has a large value of $2.8\times10^{10}$ (dyn/cm$^2$) as compared with the Young's modulus of $1.8\times10^{10}$ (dyn/cm$^2$) in the conventional diaphragm shaped from polypropylene. Further referring to the inner loss tan $\delta$, while the inner loss tan $\delta$ of the conventional diaphragm shaped from the polyethylene terephthalate is $2.0\times10^{-2}$, the inner loss is $5.2\times10^{-2}$ and $6.0\times10^{-2}$ in the diaphragm of Examples 1 or 2 according to this invention which is significantly greater. Further referring to the sound propagation velocity $\sqrt{E/\rho}$, it is 2.0 $10^5$ (cm/sec) in Example 1 and $1.4\times10^5$ (cm/sec) in Example 2. The sound propagating velosity is greater in Example 1 rather than any of the conventional products shown in Table 1 and the sound propatation velocity in Example 2 is as large as that of the conventional diaphragm shaped from polypropylene.

Furthermore, since the diaphragm according to this invention is manufactured by forming a laminate layer 5 made of a polyamide resin film 5*a* formed to the upper surface of the diaphragm main body 4 made of UKP20'SR pulp fibers as the natural fibers and further forming at the surface thereof with a synthetic resin coating layer made of nitrocellulose type lacquer enemel paint or vinyl acetate resin, pin holes are utterly eliminated to attain a satisfactory water proofness that cannot be obtained in the conventional diaphragm only made of natural fibers or those conventional diaphragms merely forming the polyamide resin laminate layer to the diaphragm main body 4 made of natural fibers, as well as the invented diaphragm is excellent in the surface gross and, further, exhibit heat resistance even at a high temperature of about 100° C.

Figure 5:
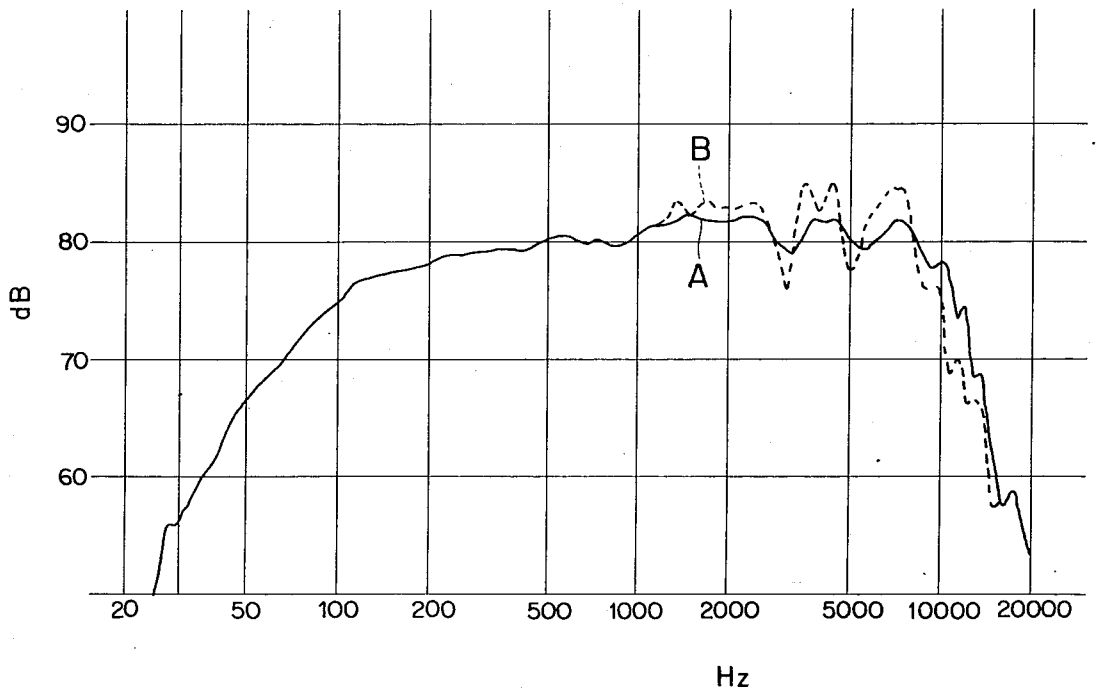
FIG. 5 is a characteristic chart for the respective sound pressure frequency characteristic for the diaphragm composed of polyethylene terephthalate and natural fiber according to this invention.

Furthermore, the diaphragm 7 in the Example 1 according to this invention can attain a flat frequency characteristic A inherent to the diaphragm made of natural fibers when compared with the conventional frequency characteristics B of the diaphragm made of 100% polyethylene terephthalate as shown in the sound pressure frequency characteristics in FIG. 5.

Although explanation has been made in the Examples 1 and 2 for the case of laminating the thermoplastic film 5*a* to the upper surface of the diaphragm main body 4, heat resistant and water proof plastic film 5*a* can, of course, be laminated on the lower surface and/or the upper surface of the diaphragm main body 4 by disposing the film 5*a* below the diaphragm main body 4 and containing them into the containing recess 2*b* of the lower die and by mating the upper die 3 relative to the lower die 2.

As described above, since the laminate layer is formed by laminating the polyamide resin to the diaphragm main body only or mainly composed of the natural fibers and further forming the synthetic resin coating layer to the surface of the laminate layer in this invention, it is suitable as the material for forming the diaphragm free from pin holes, exhibiting a satisfactory water proofness and not imparing the physical properties such as the sound propagation velocity $\sqrt{E/\rho}$ inherent to the natural fibers all over the diaphragm. Furthermore, different from the conventional diaphragm shaped from the metal member, since the diaphragm can be manufactured merely by laminating the diaphragm main body within the die and, thereafter, forming the synthetic resin coating layer to the surface of the laminate layer, it can be fabricated with ease, facilitate the fabrication work, does not worsen the yield and reduces the cost.

What is claimed is:

1. A diaphragm for use in an electro-acoustic transducer comprising a diaphragm body of fabric material, said fabric material including natural fibers;

a preformed polyamide resin film having a thickness of 20–50 μm, said polyamide resin film laminated to said diaphragm body;

a synthetic resin layer coated upon said polyamide resin film, said synthetic resin layer being selected from the group consisting of nitrocellulose type lacquer enamel and vinyl acetate resin.

* * * * *